United States Patent [19]
Yoshiwara et al.
[11] 4,318,294
[45] Mar. 9, 1982

[54] METHOD OF MANUFACTURING SEAMLESS METAL PIPES AND TUBES

[75] Inventors: Seishiro Yoshiwara; Hirokichi Higashiyama, both of Kitakyushu, Japan

[73] Assignee: Nippon Steel Corporation, Tokyo, Japan

[21] Appl. No.: 105,746

[22] Filed: Dec. 19, 1979

[30] Foreign Application Priority Data

Dec. 29, 1978 [JP] Japan ..... 53-161969
Jan. 31, 1979 [JP] Japan ..... 54-9081

[51] Int. Cl.[3] ..... B21B 17/06
[52] U.S. Cl. ..... 72/370; 72/97; 72/209
[58] Field of Search ..... 72/97, 209, 368, 370

[56] References Cited

U.S. PATENT DOCUMENTS 2,044,358 6/1936 Korbuly ..... 72/209
2,209,968 8/1940 Gould ..... 72/209
3,462,987 8/1969 Westin ..... 72/97
3,552,170 1/1971 Pfeiffer ..... 72/209

FOREIGN PATENT DOCUMENTS 870235 3/1953 Fed. Rep. of Germany ..... 72/368
1298494 7/1969 Fed. Rep. of Germany ..... 72/370
2749175 10/1978 Fed. Rep. of Germany ..... 72/209

*Primary Examiner*—Nicholas P. Godici
*Attorney, Agent, or Firm*—Wenderoth, Lind & Ponack

[57] ABSTRACT

A solid square cross-section bloom or billet is pierced to form a hollow cylindrical piece with a closed end, using a combination of a mandrel carrying a plug or piercing point at its leading end and a set of rolls. The closed-end cylindrical workpiece and the piercing mandrel together, at the completion of piercing, are fed into a rotary elongating mill, with the closed end of the workpiece foremost. Rotary elongation is performed on the workpiece while pushing the mandrel until the plug has at least passed the point at which the closed end of the workpiece clears the delivery end of the elongation rolls.

6 Claims, 7 Drawing Figures

METHOD OF MANUFACTURING SEAMLESS METAL PIPES AND TUBES

BACKGROUND OF THE INVENTION

This invention relates to a method of manufacturing seamless metal pipes and tubes.

A method of manufacturing good-quality seamless metal tubular products, for example of steel, efficiently and economically is required. Various efficiency increasing methods have been proposed. Increasing the rolling roll speed, for example, has already reached its limit, and requires a large amount of capital investment. Another method has been proposed for saving operating time other than the rolling time, such as changing the time of withdrawing the mandrel from the workpiece. According to this method, the pipe and mandrel are kicked out of the pass line after piercing and rolling. The mandrel is removed from the pipe outside the rolls. During this time, piercing or rolling is continued using another mandrel. This method can save mandrel withdrawing time, but not mandrel inserting time.

A press roll piercing method which has come into practical use recently permits direct piercing into low-cost continuously-cast blooms, dispensing with the blooming mill step. This method comprises pushing a polygonal bloom into a driven roll set having a substantially circular pass, with a plug supported by a mandrel pierced through the core to change the solid bloom into a hollow cylindrical piece. In the conventional version of this method, the mandrel is moved back after piercing, then removed from the hollow bloom, the head end of which is supported by a stripper block. By this operation, the plug and mandrel may cause scratch marks on the inside of the hollow bloom that may carry through to the finished pipe. Withdrawal of the mandrel also requires a large pulling force which can be obtained only from a large withdrawing device. After withdrawal of the mandrel, moreover, air flows into the cavity to oxidize the internal surface of the hollow bloom. The hollow bloom is then conveyed to the elongator for cross-sectional area reduction. This elongation rolling is started by propelling the hollow bloom after kicking out the preceding piece and advancing the mandrel into the rolling position.

The elongating or skew rolling process is performed on a set of rolls that have their axes inclined with respect to the pass line and that are rotated in the same direction to impart a spiral motion to the workpiece. The workpiece is rolled among the rolls and the mandrel or the plug. On completion of rolling, the workpiece is delivered to the following process, after the mandrel has been withdrawn. On some occasions, the workpiece and mandrel are kicked out together, so that the mandrel must be removed from the piece outside the pass line. In this process the internal surface of the pierced bloom is also oxidized. Part of the oxidized layer comes off when the bloom is elongated or seizes to the plug to impair the internal pipe wall smoothness. The inside oxidized layer damages the internal surface smoothness in the subsequent rolling process as well. The seizure to the plug, mandrel and other rolling tools shortens their service life.

Another efficient seamless pipe manufacturing method is the mandrel mill process. According to this method, a solid round bloom is heated to a suitable temperature, then pierced into a hollow bloom by a rotary piercing mill. After a mandrel has been inserted, the hollow bloom is rolled into a hollow shell through a mandrel mill having a series of passes formed in a plurality of driven roll sets. Following the removal of the mandrel, the hollow shell is taken out of the mandrel mill. On being reheated to a suitable temperature, the hollow shell is finished into a pipe by a stretch reducing mill.

In this conventional process, the cross-sectional dimension of the hollow shell which clears the mandrel mill is determined by the pass size in the last stand and the mandrel diameter. To fill various orders, therefore, many mandrels of different diameters must be prepared which differ in size by increments of 1 mm or so.

Further, the conventional mandrel mill process calls for providing a clearance of not less than a few millimeters between the mandrel and hollow shell to permit mandrel removal following the completion of rolling on the mandrel mill. For this reason, the last two stands of the mandrel mill do not achieve any substantial cross-sectional reduction, forming only loosening passes to separate the mandrel from the inner surface of the shell. The passes designed to provide such clearance, in addition, cause an outflow of metal into the clearances between rolls in the passes that forms longitudinal ridges, spaced apart at equal circumferential intervals, on the surface of the hollow shell. These ridges, of course, impairs the accuracy of the wall thickness.

Round bloom are sometimes replaced by continuous-cast polygonal blooms which often can be obtained at lower price and have better quality. This form of bloom is fabricated into a hollow closed-end cylindrical bloom by a press roll piercer, then rolled by a skew rolling mill into a size suited for the subsequent mandrel mill rolling. But clearly, this is not enough to obviate the aforementioned shortcomings of the conventional processes.

SUMMARY OF THE INVENTION

This invention is for eliminating the aforementioned shortcomings in the conventional seamless metal pipe manufacturing methods.

An object of this invention is to provide a method of manufacturing seamless metal pipes and tubes economically and efficiently.

Another object of this invention is to provide a method of manufacturing seamless metal pipes and tubes having a smooth surface and high dimensional accuracy.

Yet another object of this invention is to provide a method of manufacturing seamless metal pipes and tubes with less mandrel and plug wear and without requiring many mandrels of different sizes.

Designed to achieve the above-described objects, a seamless metal tubular products manufacturing method according to this invention is characterized by the steps of piercing a solid square cross-section bloom or billet into a hollow cylindrical bloom with a closed end, using a combination of a mandrel carrying a piercing plug at its leading end and a set of rolling rolls, feeding the closed end hollow bloom and the mandrel together, at completion of piercing, into a rotary elongating mill, with the closed bloom end foremost, and rotary elongating the hollow bloom while pushing the mandrel until the plug has at least passed clear of the point at which the closed end of the hollow bloom leaves the rotary elongating rolls at the delivery end of the mill.

As described above, the same mandrel which is used in the piercing process is used in the following rotary elongating process. This continued use of the same mandrel saves the time for the mandrel withdrawal and insertion steps between the two processes, resulting in higher rolling efficiency. Because it remains free from oxidation resulting from the contact with air, the inner surface of the pipe remains smooth and keeps the mandrel substantially wear-free. The rotary elongating by applying the pushing force to the advancing the mandrel permits the workpiece to enter the roll pass with greater ease. It also propels the workpiece at higher speed so as to shorten the rolling time. Enlargement of the inside diameter of the pipe by rotary elongating facilitates mandrel withdrawal, and eliminates the need for a large mandrel withdrawal device.

Continuous rolling following the rotary elongating is also started while pushing the mandrel forward, so that the effect of easier pass entry is produced the same as for the rotary elongating. This permits providing idle-roll sets on the entry end, and providing heavier reduction with fewer stands.

According to this invention, the press roll piercing and following rotary elongating processes use a common mandrel, and the continuous rolling and following rotary elongating processes use another common mandrel. In both cases, the same mandrel is recycled; it is returned to the first process on completion of rolling in the second process. This repeated use increases rolling efficiency while reducing the number of mandrel sizes required to be kept in stock.

BRIEF DESCRIPTION OF THE DRAWINGS

FIG. 5A shows an empty pass and FIG. 5B shows a pass filled with a workpiece and mandrel.

DETAILED DESCRIPTION OF THE PREFERRED EMBODIMENTS

Figure 2:
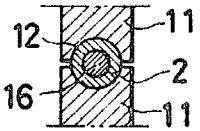
FIG. 2 is a cross section taken along the line II—II of FIG. 1.
Figure 1:
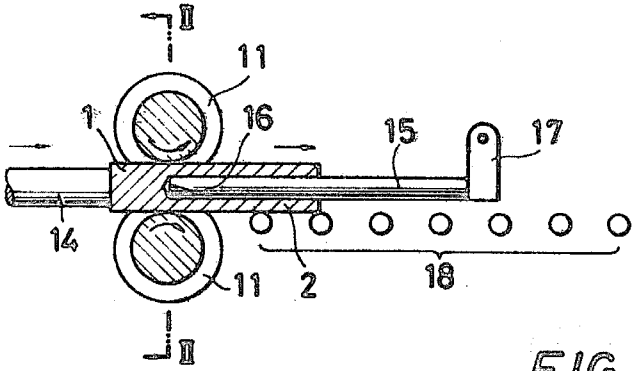
FIG. 1 is a cross-sectional side elevation illustrating the piercing process according to this invention.

Using a press roll piercer, a polygonal bloom is fabricated into a hollow cylindrical bloom with a closed end. The cross-sectional shape of the polygonal bloom may be any shape that can be continuously-cast with the highest possible quality and that is easy to handle. For example, a regular square, a rectangle, and variations thereof with some modification at the corners are preferred. These polygonal blooms, obtainable at much cheaper prices than the round blooms for the conventional processes, are fabricated into satisfactory hollow cylindrical blooms by a press roll piercer. As shown in FIG. 1, the press roll piercer comprises two or more rolls 11 that form a substantially circular pass 12 (see FIG. 2). The rolls 11 are driven to impart an advancing force to a bloom 1 which is also pushed by a pusher 14. A cylindrical plug 16 is supported by a mandrel 15 at the center of the pass to pierce the core of the bloom 1. Piercing is continued until the plug 16 reaches a little short of or emerges a little from the rearward end of the bloom. This pierced bloom is called a closed-end hollow bloom. The rearward end of this pierced bloom need not be fully closed but may have a small opening so long as it is strong enough to withstand the pushing force exerted by a mandrel in the subsequent process.

To shorten the pusher withdrawal time, the force of the pusher 14 may be applied only when the bloom enters the roll pass, as described in the Japanese Patent Publication No. 52-11157. The plug 16 can be made by machining the leading end of the mandrel into a conical or projectile shape. But it is preferred to have the plug and mandrel made of different materials and fastened together by threads etc. In this case, the plug and mandrel are made to be substantially the same diameter. On completion of piercing, a latch 17 is released to deliver the closed bottom bloom, still carrying the mandrel inside, to the next process over rollers 18. Then a new mandrel is set to start the next piercing operation.

Figure 3:
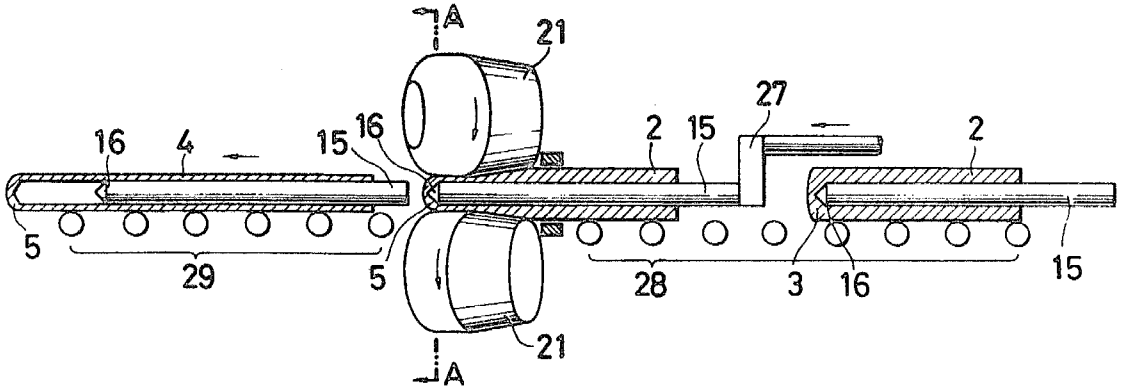
FIG. 3 is a cross-sectional side elevation illustrating the rotary elongating process according to this invention.

The second process step of this invention comprises, as shown in FIG. 3, rolling the closed-end bloom 2, still holding the mandrel 15 as it did at completion of piercing, in the opposite direction. Namely, the rearward end 3 in the first process is now reversed so as to become the head. The second process step is carried out in a rotary elongating mill. This elongator comprises two or more rolls which have their axes inclined with respect to the pass line and are rotated in the same direction. These rolls impart spiral motion to the workpiece so that reduction is performed between the rolls and the mandrel or plug. An important feature of this invention is in this step; a pusher 27 continues to push the mandrel until the plug 16 has at least passed the point at which the closed end of the hollow bloom clears the delivery end of the elongating rolls, or a plane A—A shown in FIG. 3. This makes the bloom 2 enter the roll pass easily, and prevents the failure of wall reduction in the closed end that might occur without the mandrel inside. Further, it accelerates the advance of the bloom, thereby reducing the rolling time. Until completion of rolling, the inner surface of the hollow bloom is kept out of contact with air. This reduces detrimental oxidation practically to zero. The pushing speed $v_p$ of the pusher 27 should preferably be limited to a speed within the following range:

$$0.6\,\frac{\pi Dn}{60}\sin\theta \leqq v_p \leqq 1.4\,\frac{\pi Dn}{60}\sin\theta \qquad (1)$$

where

D = maximum roll diameter n = rpm of roll $\theta$ = skew angle of roll

The lower limit set by equation (1) is that required for keeping the plug 16 in contact with the closed end 5 of the hollow bloom 4. The upper limit is that required for keeping the mandrel free from excessive pushing force. The elongation ratio (length after rolling versus length before rolling) in this process is kept within the range of 1.5 to 5.0. The numerical coefficient 1.4 for the upper limit may be increased to approximately 0.9 times the elongation ratio. Considering the balance between the capital investment of the entry-end equipment and the expected result of this invention, however, it is desirable to keep within the range of equation (1). The pushing of the mandrel can be continued until the tail end of the hollow bloom has been rolled. However, such operation requires the uneconomical condition of a mandrel that is longer than the rolled length of the hollow bloom. If the mandrel is released or its advance restrained, releasing the force of the pusher, when the leading plug of the mandrel has passed the plane A—A in FIG. 3, the closed end 5 of the rolled hollow bloom moves ahead of the plug 16, leaving a clearance therebetween. Then, the tail end of the mandrel remains exposed, left behind the tail end of the bloom. This permits long-piece rolling with a short mandrel. Then, by gripping the exposed tail end, the mandrel 15 can be withdrawn from the elongated hollow bloom 4. Following this, another mandrel which is longer than the elongated hollow bloom, kept at a desired temperature, and suitably lubricated, is inserted until the leading end thereof reaches the closed end 5 of the hollow bloom 4 which is then passed to the third process. The inside diameter enlarged by the second process just described permits withdrawing the first mandrel easily, using a small pulling device. As shown in FIG. 3, the next hollow bloom can be supplied to the rotary elongating mill as soon as the preceding bloom 4 and mandrel 15 have cleared the rolls 21. This eliminates the conventionally unreducible time for mandrel preparation, i.e., withdrawing and resetting, and elongated bloom kick-out. Hollow blooms and mandrels are continually sent in and out of this rotary elongating mill over rollers 28 and 29. The pusher 27 recedes to open the way for the incoming hollow bloom.

Figure 4:
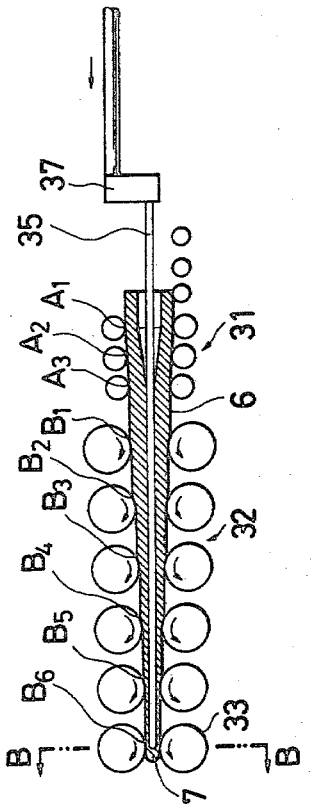
FIG. 4 is a cross-sectional side elevation illustrating the continuous rolling process according to this invention.

FIG. 4 shows an example of the third process of this invention. In this process, a pusher 37 pushes the exposed tail end of a mandrel 35. A hollow bloom 6 is passed through a series of passes, including those formed by idle rolls 31 and subsequent ones by driven rolls 32, until the leading end of the mandrel 35 has at least passed a plane B—B that passes through the center axis of the last rolls 33, whereupon the pushing force on the mandrel 35 is removed. This rolling operation produces the following results: (1) The idle rolls 31 on the entry end principally reduce the outside diameter of the hollow bloom 6, thereby decreasing the clearance between the inside diameter and the mandrel 35. This permits effective wall thickness reduction by the driven rolls 32 and increases the elongating ratio. (2) Bloom entry into the driven rolls 32 with a very small torque eliminates the need for a large-capacity driving unit. (3) The speed of the mandrel 35 varies so little that uniform fabrication is achieved throughout the entire length of the hollow bloom 6. (4) The pushing force brings the leading end of the hollow bloom 6 to the last roll set 33 in a shorter time. (5) Being derived from the closed-end bloom 2, the inner surface of the hollow bloom 6 is hardly oxidized. This provides satisfactory smoothness of the inner surface. Freedom from scale seizure prolongs the service life of the mandrel 35. (6) This process can be used to produce pipes with different wall thicknesses by changing the diameter of the mandrel. Despite the multi-diameter operation at this stage, the preceding stages can use single diameter mandrels.

This third process produces the best results when it is operated as follows: The idle rolls form substantially circular passes, having cross-sectional areas $A_1, A_2 \ldots A_m$, followed by substantially circular passes having cross-sectional areas $B_1, B_2 \ldots B_n$ provided by the driven rolls (see FIG. 5A). C is the cross-sectional area of the mandrel, and w is the pushing speed. Rolling is continued while pushing the mandrel until the leading end thereof has at least passed the center axis of the last roll set, in such a manner as to satisfy the following equations simultaneously. Then the pushing force on the mandrel is removed, so that subsequent rolling is carried out solely by the rolling force exerted by the driven rolls.

The equation defining the relationship of pass areas is:

$$A_1 > A_2 \ldots > A_m > B_1 > B_2 > \ldots > B_{n-1} \geqq B_n \tag{2}$$

This equation expresses the condition that the cross-sectional area of the passes progressively decreases toward the delivery end in the order of the passes. The suffix indicates the number of the pass counted from the entry end.

The equation for the mandrel speed is:

$$(1+a)v_i \geqq w_i \geqq (1-a)v_i \tag{3}$$

In this equation, $v_i$ is the peripheral speed at the bottom of the pass, and a is a correction coefficient to make up for the simplified expression of the equation and the representation of the peripheral roll speed by one at the pass bottom, ranging in value between 0 and 0.1.

When the leading end of the mandrel has passed the i-th driven roll set from the entry end, the pushing speed $w_i$ of the mandrel is set so as to be within plus/minus 10% of the peripheral speed at the pass bottom thereof. It has been experimentally proved preferable to equalize the mandrel pushing speed $w_i$ to the speed of the leading end of the hollow bloom that has passed the i-th driven roll set.

The equations for the driven roll speed are:

$$\left.\begin{aligned}
(1+a)v_1\frac{B_1-C}{B_2-C} &\geqq v_2 \geqq (1-a)v_1\frac{B_1-C}{B_2-C}\\
(1+a)v_1\frac{B_1-C}{B_3-C} &\geqq v_3 \geqq (1-a)v_1\frac{B_1-C}{B_3-C}\\
&\vdots\\
(1+a)v_1\frac{B_1-C}{B_n-C} &\geqq v_n \geqq (1-a)v_1\frac{B_1-C}{B_n-C}
\end{aligned}\right\} \tag{4}$$

Figure 5B:
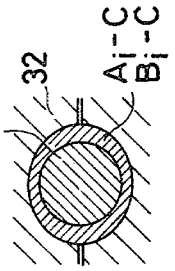
FIGS. 5A and 5B are transverse cross-sections of a roll pass of the continuous rolling mill.
Figure 5A:
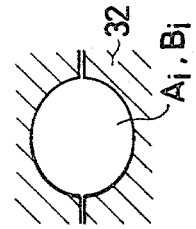

In the above equations, $v_1, v_2 \ldots v_n$ are the peripheral speeds of the driven rolls at the pass bottom thereof. The suffix indicates the number of the roll from the entry end. a is the same correction coefficient that was used in equation (3). $B_i - C$ indicates the area of the clearance between the roll 32 and mandrel 35, as shown in FIG. 5B. Equations (4) are based on the assumption that metal flows at a constant rate.

The equation defining the reduction limits for the idle rolls is:

$$0.5 \geqq \frac{A_1 - A_m}{A_1 - C} \geqq 0.1 \tag{5}$$

The second member of this equation represents the change in the area of the clearance left for the bloom passage, and is determined by subtracting the cross-sectional area of the mandrel from that of the pass, for the all the idle rolls. The upper limit is that required for permitting the hollow bloom to be propelled by the driven rolls after the removal of the mandrel pushing force. The lower limit is that required for permitting the implementation of this process that reduces the clearance between the mandrel and inner surface of the hollow bloom.

The equation defining the reduction limits for the driven rolls is:

$$0.9 \geqq \frac{B_1 - B_n}{B_1 - C} \geqq 0.4 \quad (6)$$

The second member of this equation represents the change in the area of the clearance left for the bloom passage, and is determined by subtracting the cross-sectional area of the mandrel from that of the pass, for all the driven rolls. The upper limit is determined by the smallest wall thickness rolled in this process, and is mainly related to mandrel life. The lower limit is that required for propelling the hollow bloom after removal of the pushing force. If a small value of about 0.1 to 0.3 is chosen for equation (5), the lower limit of equation (6) can be expanded to about 0.25 in practical operation. Keeping the value of equation within the above range, however, always insures stable operation.

When operated as described above, the third process can achieve the results listed previously. Result (1) is obtained by reducing the outside diameter by the idle rolls according to equation (5), and then reducing the wall thickness by the driven rolls according to equation (6). Conventionally, both the diameter and wall thickness have been reduced simultaneously by driven rolls. Therefore, conventional passes have to be definitely elliptical, which, with a round mandrel, results in heavily nonuniform circumferential wall reduction. Useless, deformation, limited elongating ratio, and poor dimensional accuracy are unavoidable, too. Result (2) is attained by pushing the closed bloom end through the rolls with the mandrel. The conditions for this operation are given by equation (3) for mandrel speed and equation (4) for driven roll speed. In contrast, entry of the bloom into each roll set in a conventional mill, lacking said pushing force, develops a torque two to three times greater than that which occurs during a steady rolling state in which the bloom is being rolled on all stands. The need to overcome this increased torque requires a larger-capacity driving unit. Larger inertia causes a delay in control. Result (3) is achieved by pushing the mandrel at a speed given by equation (3) for mandrel speed and equation (4) for driven roll speed. An the conventional full-floating mandrel mills, speed difference between the mandrel and bloom increases stepwise every time the rolls grip the leading end of the bloom. This brings about corresponding changes in bloom fabrication. This method of this invention considerably reduces these undesirable changes, continuously pushing the mandrel until the leading end of the bloom has passed the last driven roll set. Result (4) is an incidental one resulting from the higher bloom speed due to the higher mandrel speed than on conventional mills. Result (5) is attributable to several factors. Use of closed-end blooms prevents the air flow through them. Continued use of the same mandrel in the first and second processes minimizes the chance for the inner surface of the hollow bloom to come in contact with air. Lowering of the inner surface temperature by the mandrel helps slow down the oxidation rate. This effect will be enhanced by the application of a substance that prevents iron oxidation or reduces oxidized iron on the mandrel. Examples of such coating substances are graphite, petroleum, animal and vegetable oils, base metals and their salts, which function as a hot lubricator too, mixed with a suitable binder like resin. Result (6) is accomplished by increasing the inside diameter of the hollow bloom before entering the continuous rolling process. The increased inside diameter permits inserting a mandrel selected from various diameters and effective outside diameter reduction on the entry-end idle roll sets.

As will be understood from the rolling operation and results described above, the conditions given by equations (2) through (6) are applicable even when the processes preceding the third rolling process do not consist of the previously described piercing and second rolling processes. For example, closed-end hollow blooms may be prepared by other methods than press roll piercing. Also, the mandrel used in piercing may be changed to a smaller-diameter one in the second process. In either case, the above conditions can be applied to the elongation of hollow blooms.

In the above-described continuous rolling, the rolls following some entry-end idle rolls are driven. The same continuous rolling can be accomplished on a so-called push bench that comprises only idle rolls. In this case, rolling is performed while pushing the mandrel until the tail end of the workpiece has passed the last pass.

Figure 6:
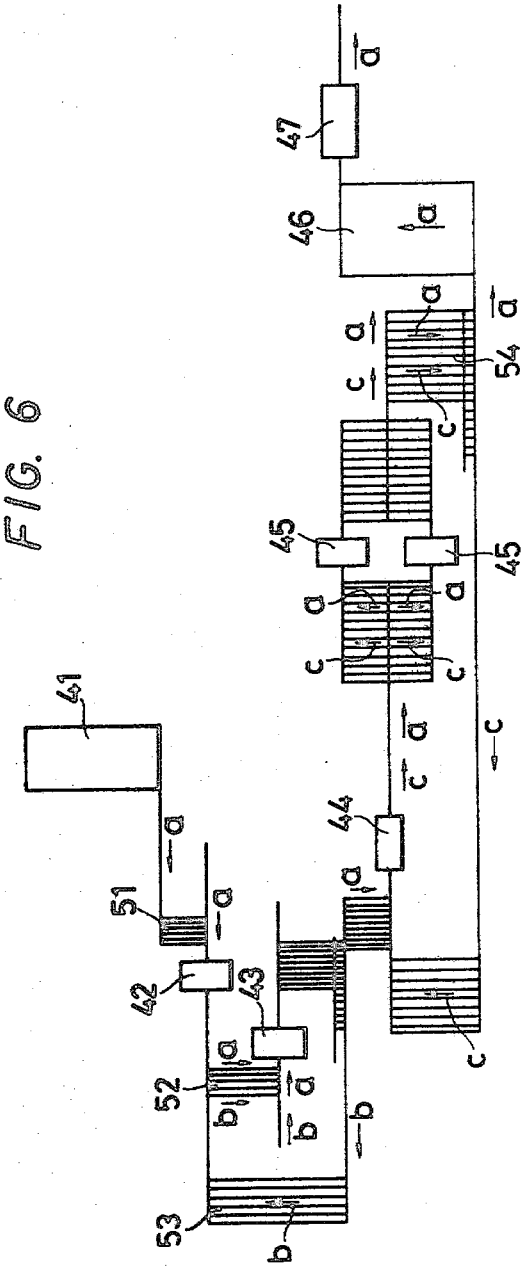
FIG. 6 is a plan view showing an example of mill layout for implementing the seamless pipe manufacturing method of this invention.

The seamless tubular product manufacturing method of this invention is carried out in a mill plant that is laid out as shown in FIG. 6. A solid polygonal bloom is heated in a heating furnace 41 to a temperature suited for hot working. The heated bloom is transferred to a press-roll piercer 42 where the leading end of a first mandrel 15 is positioned in the roll pass thereof (see FIG. 1). A pusher pushes said bloom toward the mandrel, thus preparing a hollow cylindrical bloom with a closed end 3.

On completion of piercing, the first mandrel 15 is unclamped to permit withdrawal, and still held inside the closed-end hollow bloom 2. By a table 52, the closed-end hollow bloom 2 is fed into a first rotary elongating mill 43, with the closed end thereof now the leading end. While pushing the first mandrel 15, the cross-sectional area of the closed-end hollow bloom 2 is reduced (see FIG. 3). On completion of reduction on the first rotary elongating mill 43, the first mandrel 15 is removed from the reduced closed-end hollow bloom 4, and returned to the press-roll piercer 42 for reuse by way of a table 53, as indicated by the arrows b.

In the following description, the arrows a in FIG. 6 indicate the flow of the workpiece, b the flow of the first mandrel 15, and c the flow of a second mandrel 35.

As this rotary elongating mill 43, any elongator such as Assel, Diescher and other types of elongators can be used. After withdrawal of the first mandrel 15, a second mandrel 35 is inserted in the closed-end hollow bloom 4 until the leading end thereof reaches the closed bloom end. The hollow bloom 4 is then fed into a continuous mandrel mill 44, with the closed end 5 thereof foremost, while pushing the second mandrel 35 until the leading end thereof has passed the last pass. This continuous mandrel mill 44 reduces the cross-sectional area of the hollow bloom 4 throughout the entire length thereof (see FIG. 4).

Following rolling on the continuous mandrel mill 44, the hollow shell 6, still carrying the second mandrel 35 inside, is transferred to a second rotary elongating mill 45. The hollow shell 6, with the closed end 7 thereof foremost and contacting the leading end of the second mandrel 35, is passed into the second rotary elongating mill 45 by pushing the second mandrel 35. Like the first rotary elongating mill 43, the second rotary elongating mill 45 is also constructed as shown in FIG. 3. After rolling, the second mandrel 35 is withdrawn from the hollow shell 6, then returned to the continuous mandrel mill 44 for reuse by a table 54. After cropping the closed-end 7 if necessary, hollow shell 6 is reheated to a temperature suited for the subsequent hot working in furnace 41, and finished on a sizer or stretch reducer 47.

Because it is followed by the second rotary elongating mill 45, the hollow shell 6 rolled on the continuous mandrel mill 44 may have an elliptical cross-section or undesirable ridges on its inside surface. For this reason, the continuous mandrel mill 44 can do with approximately half as many stands as conventional types.

When the hollow shell 6 and second mandrel 35 together are fed into the second rotary elongating mill 45, if the leading end of the second mandrel 35 is separated from the closed end 7 of the hollow shell 6, they are brought in contact again. A pusher (not shown) pushes the exposed tail end of the second mandrel 35 to pass the hollow shell 6 through the rolls 21 as in the mill shown in FIG. 3. By having a spiral motion imparted thereto, the hollow shell 6 is rolled into a substantially round pipe with uniform wall thickness between the rolls 21 and mandrel 35. This process can reduce wall thickness by approximately 1 to 10 mm. To vary wall thickness in a 5 mm range, for example, the conventional continuous mandrel process requires ten different mandrel differing in diameter, by 1 mm increments. In contrast, the process of the present invention can do with mandrels of a single diameter, reducing wall thickness in five steps by, for example, 4, 5, 6, 7 and 8 mm. This reduces the number of mandrel diameters required to one-tenth. Recycling of the mandrel between the continuous mandrel mill 44 and rotary elongating mill 45 requires more mandrels per diameter than conventional. Even if this requirement is doubled, however, the total number of mandrels can be reduced to one-fifth of the conventional process.

The rotary elongating mill 45 rolls even a hollow shell 6 having an elliptical cross-section or inner ridges into a round pipe with uniform wall thickness. Rolling over the long smooth mandrel 35 improves the inside-surface quality of the hollow shell 6. The reeling effect of the mill improves the outer-surface quality. From the viewpoint of efficiency balance, it is preferred to provide two second rotary elongating mills 45 having the same design as the first rotary elongating mill 43. The pipes thus produced according to the method of this invention have better quality than those prepared on conventional mandrel mills.

The following paragraphs describe concrete examples of the results obtained according to the method of this invention.

EXAMPLE I

Table I compares the thickness of the oxidized layer immediately before rolling in the second process and the roughness of the inner surface between a conventional method and the method of this invention. As seen, this invention produced better results, with the oxidized layer thickness and inner surface roughness being 15μ and 25μ in the conventional method versus 5μ and 8μ in this invention, respectively. Clearly, the method of this invention will show similar superiority for the third process, too.

EXAMPLE II

Table 2 compares the third process according to this invention with that of a conventional method. The method of this invention proved superior in total elongating ratio (between hollow shell and finished pipe), maximum torque ratio at biting, incidence of miss biting, mandrel speed variation, and finished pipe dimensional accuracy.

TABLE 1

| Description | Method | |
|---|---|---|
| | Conventional | This Invention |
| 1st Process (Press Roll Piercer) | | |
| Workpiece Quality | Low carbon killed steel | Same as left |
| Bloom Cross-section | 80 mm square | Same as left |
| Pierced Cross-section | 91 mm dia. with 22 mm thick wall and open ends | Same as left, but with a closed end |
| Plug Diameter | 45.5 mm | Same as left |
| Mandrel Diameter | 45.0 mm | Same as left |
| Heating Temperature | 1250 °C. | Same as left |
| Mandrel Withdrawal | Done | Not done |
| 2nd Process (Elongator) | | |
| Rolled Cross-section | 90 mm dia. with 12 mm thick wall | Same as left |
| Roll Skew Angle ($\theta$) | 6.0 degrees | Same as left |
| $\pi Dn/60 \sin\theta$ | 1.21 m/sec. | Same as left |
| Pushing Speed ($V_p$) | — | 1.3 m/sec. |
| Mandrel Diameter | 43.0 mm | 45.0 mm |
| Delivery Side Advance Speed | 1.1 m/sec. | 1.3 m/sec. |
| Oxidized Layer Thickness Just before Rolling in 2nd Process | 15 μm | 5 μm |
| Inner Surface Roughness after Rolling in 2nd Process | 25 μm | 8 μm |

TABLE 2

| Description | Method | |
|---|---|---|
| | Conventional | This Invention |
| Hollow shell cross-section | 81 mm dia. with 8.0 mm thick wall | 95 mm dia. with 8.0 mm thick wall |

TABLE 2-continued

| Description | Method | |
|---|---|---|
| | Conventional | This Invention |
| Finished pipe cross-section | 69 mm dia. with 4.0 mm thick wall | 69 mm dia. with 4.0 thick wall |
| Idle roll passes $A_1$-C | — | 2847 $mm^2$ |
| $A_2$-C | — | 1829 |
| Driven roll passes $B_1$-C | 1358 $mm^2$ | 1358 $mm^2$ |
| $B_2$-C | 1021 | 1021 |
| $B_3$-C | 912 | 912 |
| Driven roll pass bottom speeds $v_1$ | 200 mm/sec. | 200 mm/sec. |
| $v_2$ | 280 | 266 |
| $v_3$ | 360 | 300 |
| Mandrell pushing speed w | — | 320 mm/sec. |
| Total elongating ratio | 2.25 | 2.68 |
| Maximum toque ratio at bitting | | |
| No. 1 driven roll | 1.0 | 0.3 |
| No. 2 driven roll | 1.0 | 0.4 |
| No. 3 driven roll | 1.0 | 1.0 |
| Incidence of miss biting | 12% | 0 |
| Ratio of mandrel speed variation | 1.8 | 1.2 |

The data in Examples I and II were obtained by a testing continuous rolling mill on the ½ scale. Evidently, full-scale commercial mills are supposed to exhibit the same tendency.

As described above, the method of this invention permits manufacturing high-quality seamless metal pipes and tubes economically and efficiently. It greatly saves mandrel and plug wear end eliminates the need of preparing mandrels of many different diameters, too. Despite the additional press-roll piercer and rotary elongating mill, reduction in the number of stands making up the continuous mandrel mill lowers production cost as a whole.

What is claimed is:

1. In a method of manufacturing seamless metal pipes and tubes having the steps of piercing a solid bloom by passing it through a set of rolls and over a mandrel carrying a piercing plug at the leading end thereof, and then elongating the resulting hollow cylindrical bloom by passing it through a rotary elongating mill, the improvement which comprises:

using as a mandrel for piercing the solid bloom a mandrel having a diameter substantially equivalent in size to that of the piercing plug and piercing the solid bloom into a hollow cylindrical bloom having a closed end;

in the elongating step, feeding the closed-end hollow bloom with said piercing mandrel remaining therein into the rotary elongating mill with the closed end of the bloom foremost for thereby keeping the cylindrical hollow bloom closed during the time this step is being carried out; and pushing said mandrel until the plug has at least passed the point at which the closed end of the hollow bloom clears the delivery end of the rotary elongating mill.

2. The improvement according to claim 1 further comprising, after completion of elongating by said rotary elongating mill, withdrawing the piercing mandrel and inserting into the bloom a further mandrel longer than the length to which the hollow bloom is to be finally elongated until the leading end of said further mandrel reaches the closed end of the bloom;

continuously rolling the closed end hollow bloom by passing it through a plurality of sets of rolls forming roll passes, at least some of which at the delivery end of the plurality of sets of rolls are driven, while pushing the leading end of the mandrel against the closed end of the bloom until the closed end has at least cleared the pass formed by the last roll set; and when the leading end of the mandrel has cleared the pass formed by the last roll set, stopping the pushing on the mandrel and performing the rest of the continuous rolling using only the driven roll sets.

3. A method according to claim 1 or 2 wherein said piercing step comprises press-roll piercing a polygonal bloom.

4. A method according to claim 3 wherein said bloom is a continuously-cast bloom.

5. A method according to claim 2 wherein said step of continuously rolling is performed by rolling in a mill having a plurality of sets of idle-rolls on the entry end and a plurality of sets of driven rolls on the delivery end.

6. A method of manufacturing seamless metal pipes and tubes comprising the steps of:

forming substantially round passes, having cross-sectional areas $A_1$, $A_2$ . . . Am, by idle-roll sets, followed in tandem by substantially round passes, having cross-sectional areas $B_1$, $B_2$ . . . $B_n$, by driven-roll sets;

continuous-rolling a closed-end hollow bloom by pushing a mandrel having a cross-sectional area C at a speed w until the leading end thereof has passed the center axis of the last roll set according to equations (1) through (5) simultaneously;

$$A_1 > A_2 > \ldots > A_m > B_1 > B_2 > \ldots > B_{n-1} \geqq B_n \quad (1)$$

$$(1 + a)v_i \geqq w_i \geqq (1 - a)v_i \quad (2)$$

$$\left.\begin{aligned} (1 + a)v_1 \frac{B_1 - C}{B_2 - C} &\geqq v_2 \geqq (1 - a)v_1 \frac{B_1 - C}{B_2 - C} \\ (1 + a)v_1 \frac{B_1 - C}{B_3 - C} &\geqq v_3 \geqq (1 - a)v_1 \frac{B_1 - C}{B_3 - C} \\ &\vdots \\ (1 + a)v_1 \frac{B_1 - C}{B_n - C} &\geqq v_n \geqq (1 - a)v_1 \frac{B_1 - C}{B_n - C} \end{aligned}\right\} \quad (3)$$

$$0.5 \geqq \frac{A_1 - A_m}{A_1 - C} \geqq 0.1 \quad (4)$$

-continued $$0.9 \geqq \frac{B_1 - B_n}{B_1 - C} \geqq 0.4 \quad (5)$$

where $w_i$=mandrel pushing speed when the leading end thereof has passed the i-th driven roll $v_1, v_2 \ldots v_n$=peripheral speeds of driven rolls at their pass bottom, suffix indicating the number of the number of the roll from the entry end a=correction coefficient to make up for equation simplification, ranging in value between 0 and 0.1 removing the pushing force of the mandrel; and performing the rest of rolling using only the rolling force of the driven rolls.

* * * * *